US006630777B2

(12) United States Patent
Kwon et al.

(10) Patent No.: US 6,630,777 B2
(45) Date of Patent: Oct. 7, 2003

(54) ELECTRON GUN AND COLOR CATHODE-RAY TUBE UTILIZING THE SAME

(75) Inventors: Yong-geol Kwon, Kyungki-do (KR); Young-jun Yoon, Kyungki-do (KR); Deog-ho Kim, Kyungki-do (KR); Yang-je Lee, Kyungki-do (KR); Kwang-jin Yun, Kyungki-do (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 463 days.

(21) Appl. No.: 09/768,351

(22) Filed: Jan. 25, 2001

(65) Prior Publication Data

US 2001/0030502 A1 Oct. 18, 2001

(30) Foreign Application Priority Data

Mar. 14, 2000 (KR) ..... 2000-12845

(51) Int. Cl.[7] ..... H01J 29/70
(52) U.S. Cl. ..... 313/431
(58) Field of Search ..... 313/412, 414, 313/428, 431, 432, 437, 439, 460, 413

(56) References Cited

U.S. PATENT DOCUMENTS 5,818,156 A 10/1998 Misono ..... 313/412
5,912,530 A 6/1999 Misono et al. ..... 313/412

FOREIGN PATENT DOCUMENTS

JP 10-116569 5/1998
JP 10-116570 5/1998

*Primary Examiner*—William Oen
(74) *Attorney, Agent, or Firm*—Leydig, Voit & Mayer, Ltd.

(57) ABSTRACT

A color cathode-ray tube includes a housing including a panel having a phosphor screen on its inside and a funnel fastened to the panel, the funnel including a neck portion; an electron gun housed in the neck portion and emitting electron beams for exciting the phosphor screen and forming an image, the electron gun including cathodes arranged in line, electrodes sequentially disposed from the cathodes and having electron beam passages for passing three electron beams, a shield cup coupled to a last electrode among the electrodes and provided with three electron beam passages in line, and magnetic pieces disposed on the shield cup or one or more electrodes so that the center of a coma correction portion composed of the magnetic pieces is positioned above and below the line and in spaces between the center of a central electron beam passage and the centers of side electron beam passages; and a deflection yoke disposed on the neck and cone portions of the funnel, the deflection yoke deflecting electron beams emitted from the electron gun to land on positions on the phosphor screen.

20 Claims, 14 Drawing Sheets

FIG, 12B

ELECTRON GUN AND COLOR CATHODE-RAY TUBE UTILIZING THE SAME

BACKGROUND OF THE INVENTION

1. Field of the Invention

The present invention relates to a color cathode-ray tube, and more particularly, to an electron gun having an improved shield cup to improve the deflection (defocusing or aberration) or coma, and a color cathode-ray tube using the same.

2. Description of the Related Art

FIG. 1 shows a cathode-ray tube employing a deflection yoke of self-convergence, the cathode-ray tube used for televisions and monitors. As shown in FIG. 1, a color cathode-ray tube 10 includes a panel 12 having a phosphor screen 11, on which red, green and blue phosphor materials are provided in a dotted or striped pattern, in the inside; a funnel 13 which includes a neck portion 13*a* and a cone portion 13*b* and is fastened to the panel 12; an electron gun 20 housed in the neck portion 13*a* of the funnel 13; and a deflection yoke 15 provided throughout the cone portion 13*b* of the funnel 13 to deflect electron beams emitted from the electron gun 20.

As shown in FIG. 2, the electron gun 20 includes three cathodes 21 arranged in line, a plurality of electrodes 22 which are spaced apart from the cathodes 21 by a predetermined distance and having three electron beam passages arranged in line, a final accelerating electrode 23, and a shield cup 24 provided on the final accelerating electrode 23.

In the color cathode-ray tube 10 having such a configuration, three electron beams emitted from the electron gun 20 are selectively deflected by the deflection yoke 15 and land on the phosphor screen 11, exciting phosphor materials, so that an image is displayed.

During this procedure, a deflection magnetic field deflecting electron beams emitted from the electron gun 20 is composed of a pincushion-shaped horizontal deflection magnetic field HB and a barrel-shaped vertical deflection magnetic field VB, as shown in FIG. 3, so that it can converge the three beams arranged in line to the phosphor screen 11 without additional dynamic convergence. However, as shown in FIG. 4, the flux density of a magnetic field formed by a deflection yoke increases from the center toward the periphery in a horizontal direction, so the cross-sections of the red (R) and blue (B) electron beams, among the three electron beams (R, G and B electron beams) arranged in line, are distorted. In other words, as shown in FIG. 5, the R and B electron beams are subjected to forces in arrow headed directions by the pincushion magnetic field HB of a deflection yoke, so that halos are formed around the R and B electron beams. A halo phenomenon appearing in the R and B electron beams becomes worse toward the periphery of a phosphor screen, as shown in FIG. 6. Accordingly, the magnitude of an electron beam landing on the periphery of the phosphor screen changes. The halo phenomenon of an electron beam and the non-uniformity of the cross-section of the electron beam degrade the resolution of an image formed by exciting the phosphor screen.

Examples of an electron gun for reducing the problem of a coma are disclosed in Japanese Patent Publication No. Hei 4-52586, Japanese Patent Laid-open No. Sho 51-61766, Japanese Patent Laid-open No. Sho 51-64368 and Japanese Patent Publication No. Hei 10-116569.

According to the disclosed technical configurations, upper and lower flat electrodes narrowing the paths of three electron beams are disposed on the bottom face of a shield cup of an in-line type electron gun, parallel to the in-line direction of the electron beams and extending toward a main lens or a phosphor screen. Alternatively, an electron gun is designed such that an electrostatic quadrupole lens is formed between some electrodes, and the strength of the electrostatic quadrupole lens varies with a deflection signal corresponding to the deflection of an electron beam, thereby achieving uniformity of an image over the entire screen. In another example, an astigmatic lens is provided in a region between electrodes forming a prefocus lens to achieve the uniformity of the cross-section of an electron beam over the entire phosphor screen. In still another example, the electron beam passages of first and second electrodes of an electron gun have different aspect ratios, thereby preventing the distortion of electron beams landing on the center and periphery of a phosphor screen.

Japanese Patent Publication No. Hei 10-116570 discloses a configuration for correcting the deflection of electron beams, in which magnetic pieces are partially disposed in electrodes forming an electron gun installed in the neck portion of a cathode-ray tube, and a magnetic field generating device is disposed on the outer surface of the neck portion, thereby generating a magnetic field synchronized with a deflection signal and exciting the magnetic pieces.

U.S. Pat. No. 5,912,530 discloses a configuration for correcting deflection using a deflection magnetic field, in which left and right magnetic pieces are disposed in one of the electrodes of an electron gun emitting three electron beams in line, and magnetic pieces are disposed between a center electron beam and peripheral electron beams.

U.S. Pat. No. 5,818,156 discloses a configuration for correcting deflection, in which magnetic materials are attached to the upper and lower portions of each of the side electron beam passages in a shield electrode within a deflection magnetic field.

As described above, when the shape of an electron beam passage is transformed or the magnifying power of an electron lens is varied in synchronization with a signal applied to a deflection yoke, to correct the deflection of an electron beam using a deflection magnetic field, it is difficult to manufacture an electron gun and control electron beams. In addition, when magnetic pieces are attached to both sides of each of the electron beam passages arranged on the bottom face of a shield cup in line and attached between the electron beam passages, the complexity of the shape of the magnetic pieces causes excessive dissemination depending on the shape of parts and result in difficult assembly, thereby disturbing the improvement of productivity.

SUMMARY OF THE INVENTION

To solve the above problems, it is an object of the present invention to provide an in-line type electron gun for reducing deflection (defocusing or aberration) or coma due to the non-uniform magnetic field of a deflection yoke and reducing a voltage difference due to the deflection of side electron beams arranged in line, thereby improving the resolution of an image throughout a phosphor screen, and a color cathode-ray tube using the electron gun.

Accordingly, to achieve the above object of the invention, in first aspect, there is provided an electron gun for a color cathode-ray tube. The electron gun includes cathodes arranged in line, a plurality of electrodes sequentially disposed from the cathodes and having electron beam passages for passing three electron beams, a shield cup coupled to a last electrode among the plurality of electrodes and provided with three electron beam passages in line, and at least one coma correction portion disposed on the shield cup or one or more electrodes among the plurality of electrodes in such a manner of positioning the coma correction portion above and below the spaces between the center of a central electron beam passage and the centers of side electron beam passages.

In second aspect, there is provided an electron gun for a color cathode-ray is tube. The electron gun includes three cathodes arranged in line, a control electrode, a screen electrode, a plurality of focus electrodes sequentially disposed from the screen electrode and forming an auxiliary lens and a main lens, a final accelerating electrode, a shield cup coupled to the final accelerating electrode and provided with three electron beam passages arranged in line, and at least a pair of coma correction portions which are disposed on the shield cup or one among the plurality of focus electrodes in such a manner of positioning the centers of magnetic pieces above and below the spaces between the center of a central electron beam passage and the centers of side electron beam passages among the three electron beam passages formed on the control electrode and the screen electrode.

In third aspect, there is provided an electron gun for a color cathode-ray tube, including three cathodes arranged in line; a control electrode and a screen electrode which are sequentially disposed from the cathodes; a plurality of focus electrodes sequentially disposed from the screen electrode and to which a dynamic focus voltage synchronized with a deflection signal is applied, thus forming a quadrupole lens; a final accelerating electrode disposed to be adjacent to the focus electrodes and forming a main lens; a shield cup coupled to the final accelerating electrode and provided with three electron beam passages arranged in line; and at least a pair of magnetic pieces which are disposed on the shield cup or one among the plurality of focus electrodes in such a manner of positioning the magnetic pieces above and below the spaces between the center of a central electron beam passage and the centers of side electron beam passages among the three electron beam passages formed on the control electrode, the screen electrode and a shield cup.

To achieve the above object of the invention, there is also provided a color cathode-ray tube including a housing including a panel having a phosphor screen on its inside and a funnel fastened to the panel, the funnel including a neck portion; an electron gun housed in the neck portion and emitting electron beams for exciting the phosphor screen and forming an image, the electron gun including cathodes arranged in line, a plurality of electrodes sequentially disposed from the cathodes and having electron beam passages for passing three electron beams, a shield cup coupled to a last electrode among the plurality of electrodes and provided with three electron beam passages in line, and magnetic pieces disposed on the shield cup or one or more electrodes among the plurality of electrodes in such a manner of positioning the magnetic pieces above and below the spaces between the center of a central electron beam passage and the centers of side electron beam passages; and a deflection yoke disposed throughout the neck and cone portions of the funnel, the deflection yoke deflecting electron beams emitted from the electron gun to phosphor positions on the phosphor screen.

Preferably, the magnetic pieces constructing the comma correction portion have a circular plate shape or a polygonal shape, the diameter of the magnetic pieces is 1 mm or more and 4 mm or less, and the thickness of the magnetic pieces is 0.1 mm or more and 2.0 mm or less. Preferably, a magnetic field distribution formed by the pair of coma correction portions is symmetric with respect to a direction in which the electron beam passages arranged in line on the shield cup or the electrodes.

BRIEF DESCRIPTION OF THE DRAWINGS

The above objective and advantages of the present invention will become more apparent by describing in detail preferred embodiments thereof with reference to the attached drawings in which:

FIGS. 12A and 12B are diagrams illustrating the relation between the deflection of electron beams and a deflection magnetic field and magnetic pieces;

DETAILED DESCRIPTION OF THE PRESENT INVENTION

Figure 7:
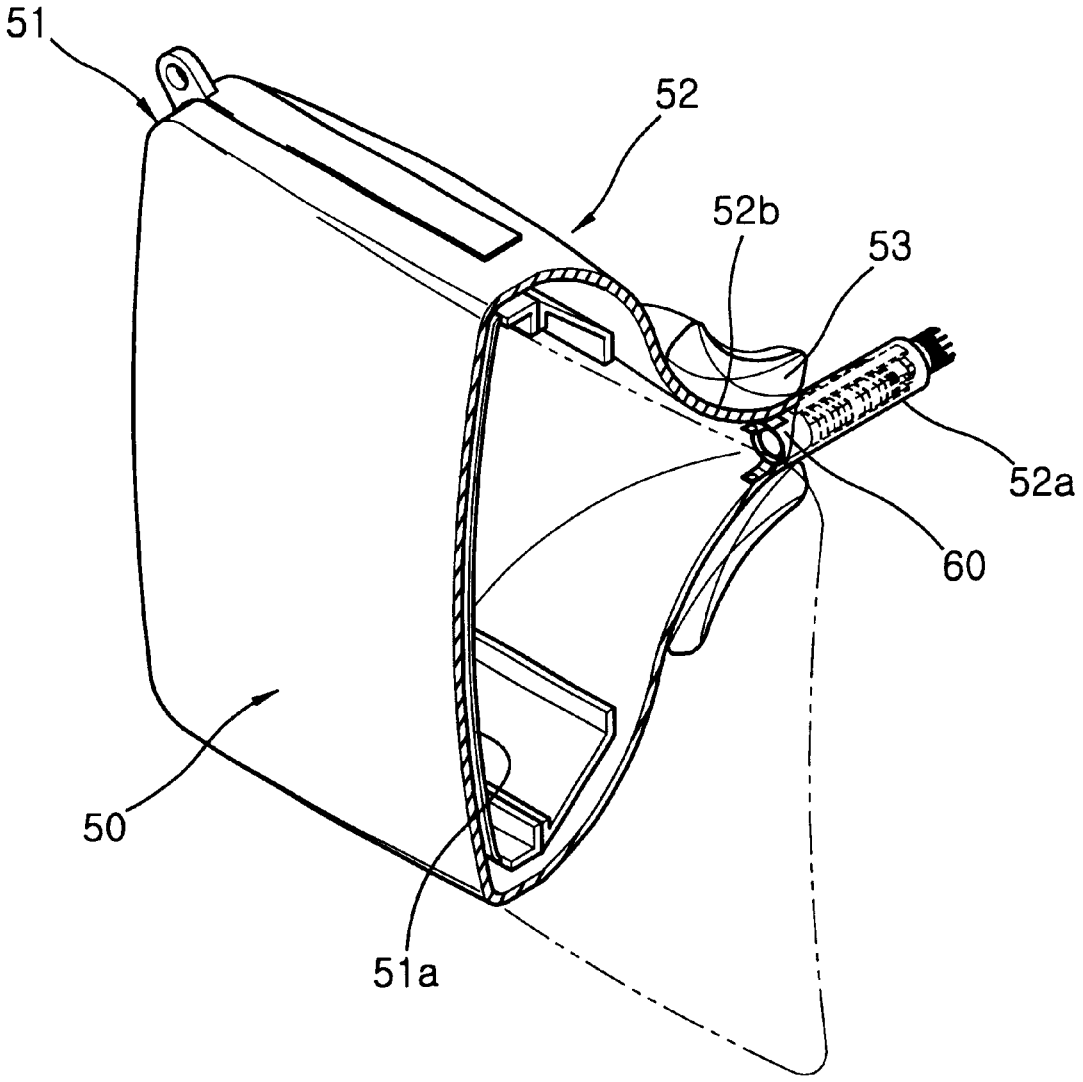
FIG. 7 is a partially cutaway, perspective view illustrating a color cathode-ray tube according to the present invention.

Referring to FIG. 7, a color cathode-ray tube 50 includes a panel 51 having a phosphor screen 51*a*, on which red, green and blue phosphor materials are provided in a dotted or striped pattern, in the inside; a funnel 52 which includes a neck portion 52*a* and a cone portion 52*b* and is fastened to the panel 51; an electron gun 60 installed in the neck portion 52*a* to excite the phosphor screen 51*a*; and a deflection yoke 53 provided on the neck and cone portions 52*a* and 52*b* of the funnel 52.

Figure 8:
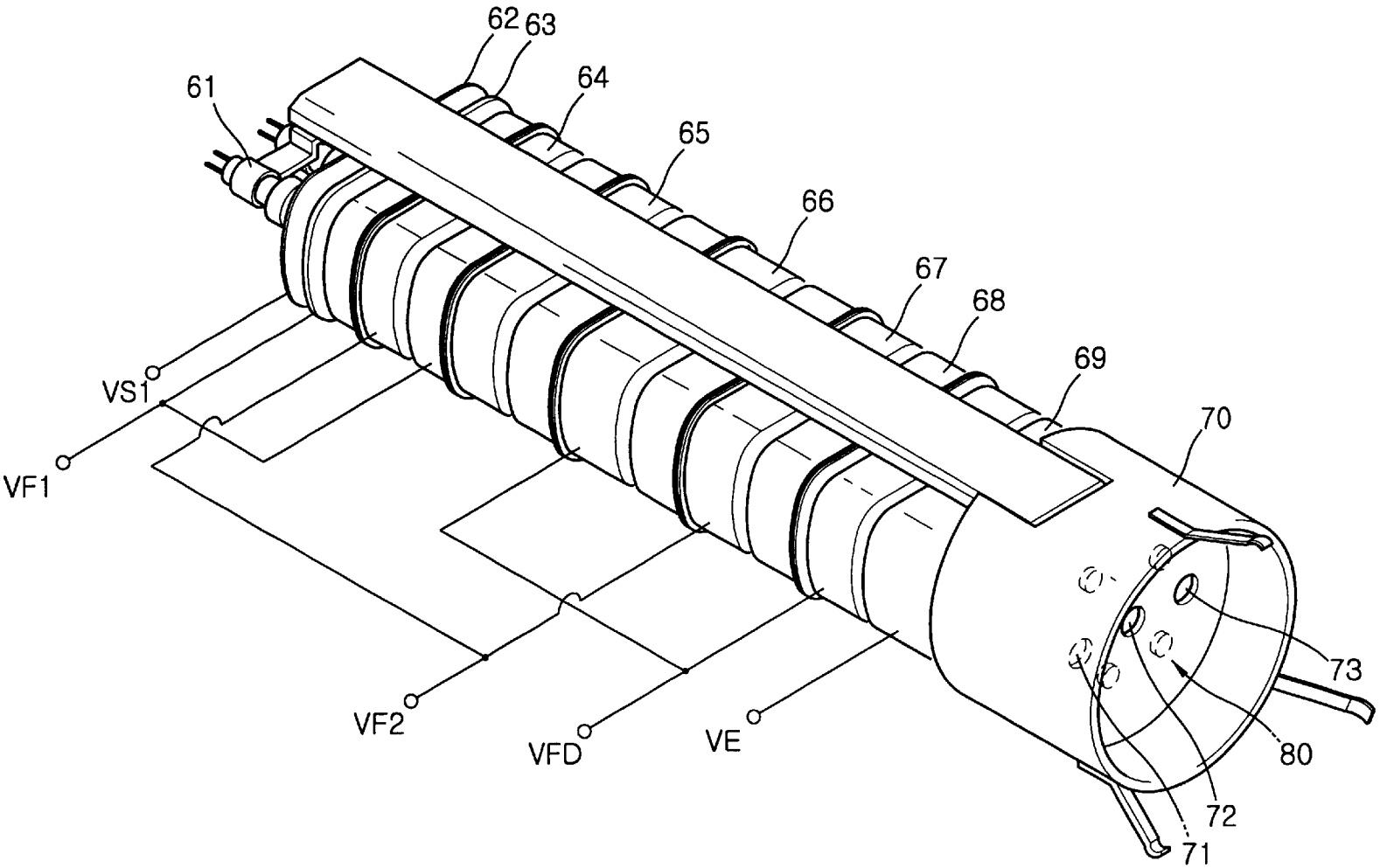
FIG. 8 is a perspective view illustrating an electron gun according to the present invention and showing the relation of voltage applications.

As shown in FIG. 8, the electron gun 60 includes a triode including three cathodes 61 which are arranged in line as sources of generating electron beams and a control electrode 62 and a screen electrode 63 which are sequentially disposed from the cathode 61, first through fifth focus electrodes 64, 65, 66, 67 and 68 which are sequentially disposed from the screen electrode 63 and form an auxiliary lens and a main lens, final accelerating electrode 69 disposed adjacent to the fifth focus electrode 68, and a shield cup 70 coupled to the final accelerating electrode 69. Each of the electrodes is provided with separated electron beam passages or a common large diameter electron beam passage to focus and accelerate electron beams. R, G and B electron beam passages 71, 72 and 73 for passing three R, U and B electron beams are formed on the bottom face of the shield cup 70. A coma correction portion 80 for reducing the deflection coma of electron beams due to the deflection magnetic field of a deflection yoke and the coma of a coma-free magnet is disposed on the bottom face of the shield cup 70 or at least one electrode among the first through fourth focus electrodes 64 through 67. Here, the pincushion magnetic field of the deflection yoke and the magnetic field of a coma-free magnet are barreled and weakened by the coma correction portion 80 to satisfactorily correct the coma.

The coma correction portion 80 is disposed on the bottom face of the shield cup 70 or one of the first through fourth focus electrodes such that it is positioned above and below regions corresponding to spaces among the centers of the three R, G and B electron beams emitted from the cathodes 61 arranged in line.

Figure 9A:
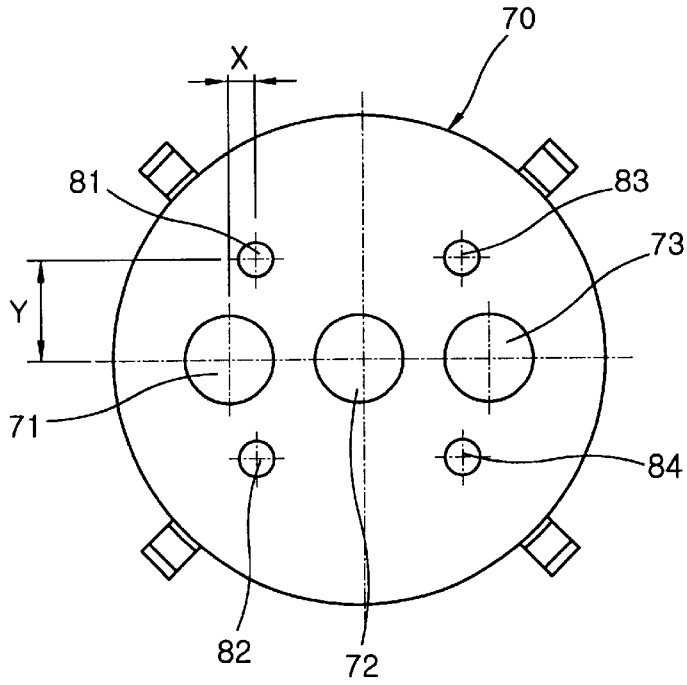
FIG. 9A is a bottom view of the shield cup of FIG. 8.
Figure 9B:
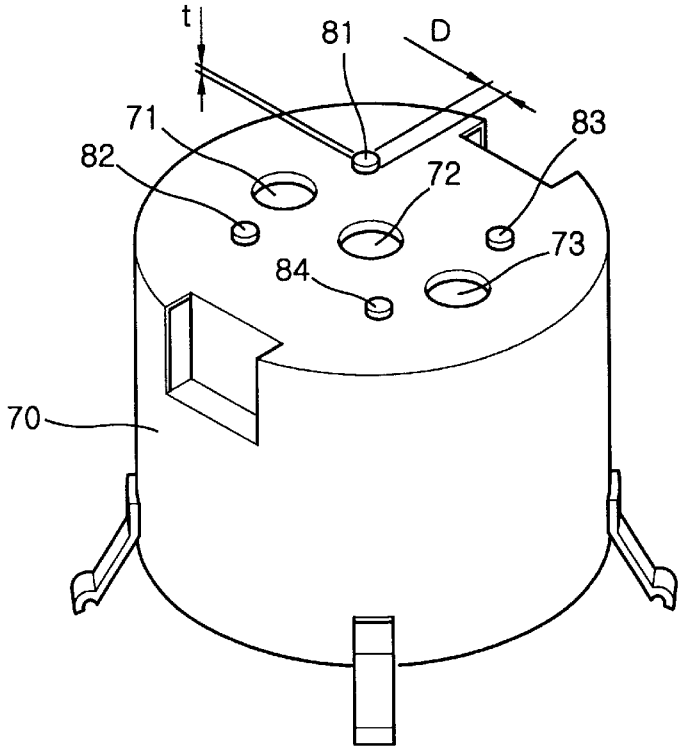
FIG. 9B is a perspective view of the shield cup of FIG. 8.

FIGS. 9A and 9B show an embodiment of the coma correction portion 80 provided on the bottom face of the shield cup 70. As shown in FIGS. 9A and 9B, the coma correction portion 80 is formed such that the centers of magnetic pieces 81, 82, 83 and 84 of a circular plate are positioned at portions (arranged in a direction perpendicular to a direction in which the R, G and B electron beam passages are arranged) above and below the line along which the centers of the R, G and B electron beam passages 71, 72 and 73 are aligned, on the bottom face of the shield cup 70, and, in spaces between the center of the G electron beam passage 72 and the centers of the R and B electron beam passages 71 and 73. Preferably, the thickness "t" of the magnetic pieces 81–84 of a circular plate is more than 0.1 mm and less than 2.0 mm. More preferably, the thickness "t" is 0.4 mm. The diameter D of the magnetic pieces 81–84 is more than 2 mm and less than 4 mm. More preferably, the diameter D is 2.5 mm. It is preferable that the center of each of the magnetic pieces 81 and 82 is spaced from the center of the R electron beam passage 71 by 0.5–3.0 mm toward the G electron beam passage 72, and the center of each of the magnetic pieces 83 and 84 is spaced from the center of the B electron beam passage 73 by 0.5–3.0 mm toward the G electron beam passage 72. More preferably, the centers of the magnetic pieces 81 and 82 are spaced from the R electron beam passage 71 by 1.5 mm, and the centers of the magnetic pieces 83 and 84 are spaced from the B electron beam passage 73 by 1.5 mm. The center of each of the magnetic pieces 81 and 82 is spaced from the center of the R electron beam passage 71 and the center of each of the magnetic pieces 83 and 84 is spaced from the center of the B electron beam passage 73, by 2.5–4.5 mm in a vertical direction, that is, a direction perpendicular to a direction in which the passages 71, 72 and 73 are arranged. More preferably, the vertical distance between the centers of magnetic pieces 81 and 82 of the center of the passage 71 and the vertical distance between the centers of magnetic pieces 83 and 84 of the center of the passage 73 are 3.5 mm. The positions of the magnetic pieces 81, 82, 83 and 84 are not restricted to the above embodiment, but can be modified such that the centers thereof are positioned between the centers of the R and B electron beam passages and the center of the G electron beam passage.

In another embodiment of the present invention, magnetic pieces may be disposed such that their centers are positioned above and below the spaces between central electron beam passages of the control electrode 62 and the screen electrode 63 constructing a triode and the side electron beam passages of the control electrode 62 and the screen electrode 63.

Figure 10:
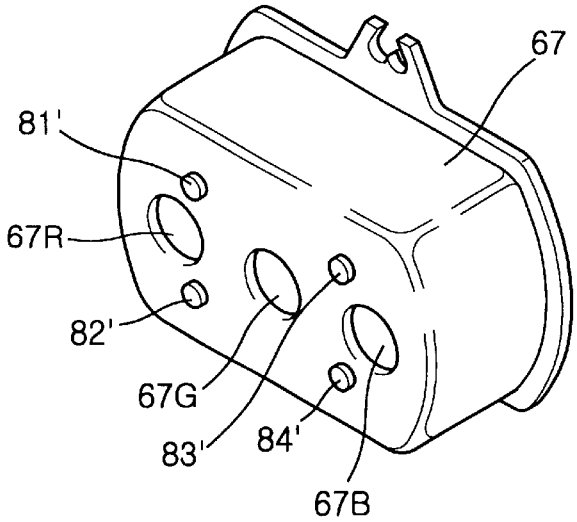
FIG. 10 is a view illustrating an electrode of an electron gun according to the present invention and a state in which magnetic pieces are attached to the electrode.

FIG. 10 illustrates a configuration in which a coma correction portion is provided on the incident side of a focus electrode. As shown in FIG. 10, magnetic pieces 81', 82', 83' and 84' as described above are attached above and below the line along which the centers of three electron beam passages 67R, 67G and 67B are arranged on the incident side of the focus electrode 67. The magnetic pieces 81', 82', 83' and 84' are positioned with respect to the R and B electron beam passages in the same manner as described above.

According to the embodiments described above, a coma correction portion is provided on the bottom face of a shield cup or the incident side of a fourth focus electrode, but the present invention is not restricted to these embodiments. The coma correction portion can be provided on any region which is subjected to the influence of a deflection magnetic field so that deflection due to the deflection magnetic field for deflecting electron beams can be corrected. The shape of the magnetic pieces 81–84 and 81'–84' is not restricted to a circular plate but can be modified into a variety of shapes. It is preferable that a magnetic piece is made of a material containing 30–70% nickel. More preferably, magnetic pieces having 42 or 72% nickel content are used.

In an electron gun having the configuration described above, predetermined voltages are applied to individual electrodes forming the electron gun. This will be described below.

A first constant voltage VS1 is applied to the control electrode 62. A first focus voltage VF1 is applied to the screen electrode 63 and the second focus electrode 65. A second focus voltage VF2 is applied to the first and fourth focus electrodes 64 and 67. A dynamic focus voltage VFD synchronized with the deflection signal of the deflection yoke is applied to the third and fifth focus electrodes 66 and 68. The application of voltages to the electrodes is not restricted to the above embodiment, but any method of realizing a voltage application structure capable of forming a quadrupole lens can be used.

The operation of an electron gun according to the present invention and the operation of a cathode-ray tube using the electron gun will be described below.

In a color cathode-ray tube according to the present invention, once a predetermined potential is applied to the parts and electron gun constructing the color cathode-ray tube, three electron beams emitted from cathodes are focused and accelerated by electron lenses formed among electrodes constructing the electron gun and deflected by a deflection yoke depending on the scan positions of the electron beams on a phosphor screen, so that the electron beams land on the phosphor screen.

Figure 11:
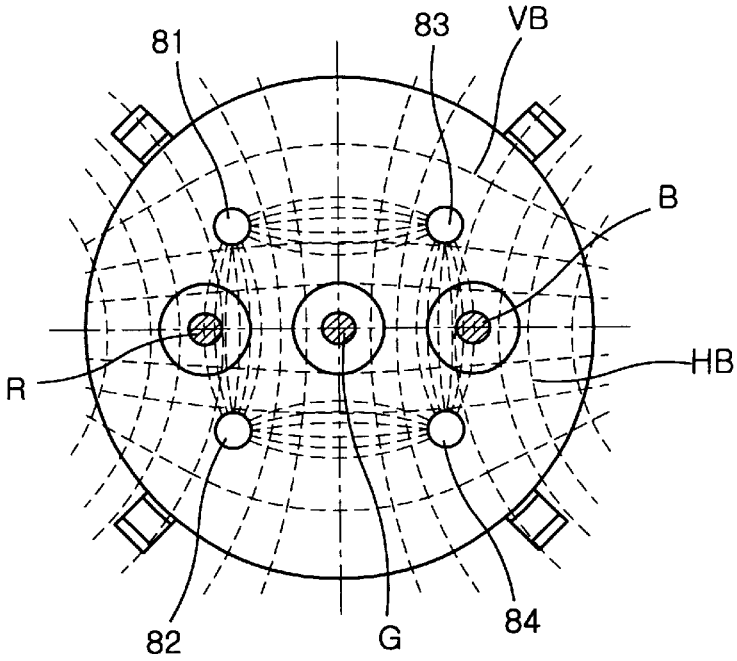
FIG. 11 is a view in which a deflection magnetic field and magnetic fields due to magnetic pieces on a shield cup are visualized.

During this procedure, as deflection magnetic fields formed by the deflection yoke used for deflecting the electron beams shot by the electron gun, a barrel magnetic field VB for deflecting the R, G and B electron beams in a vertical direction and a pincushion magnetic field HB for deflecting the R, G and B electron beams in a horizontal direction are formed, as shown in FIG. 11. Since the magnetic pieces 81–84 are attached to the bottom of the shield cup 70, the pincushion magnetic field HB for deflecting the side R and B electron beams is barreled, and the barrel deflection field VB is pincushioned, so that the distortion of the electron beams is corrected.

Figure 12A:
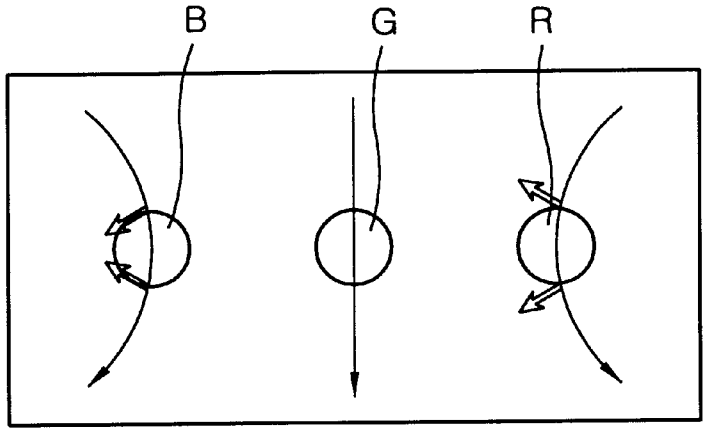
Figure 12A:
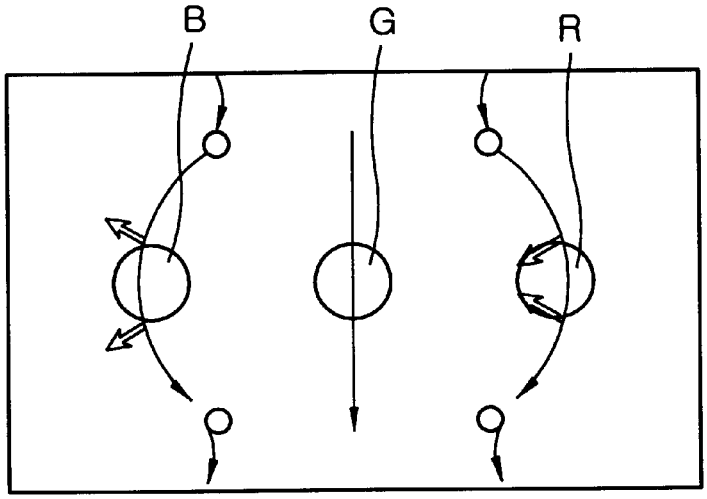

As shown in FIG. 12A, the B and R electron beams passing through the pincushion magnetic field which is a horizontal deflection magnetic field are subjected to focusing power and diverging power, respectively, and thus distorted. Since the magnetic pieces 81, 82, 83 and 84 are disposed above and below the R and B electron beam passages, a barrel-shaped horizontal deflection magnetic field is formed over the R and B electron beam passages, so diverging power and focusing power are given to the B and R electron beams, respectively, in an opposite direction to the pincushion magnetic field, as shown in FIG. 12B, thereby correcting the distortion of the electron beams.

Figure 1:
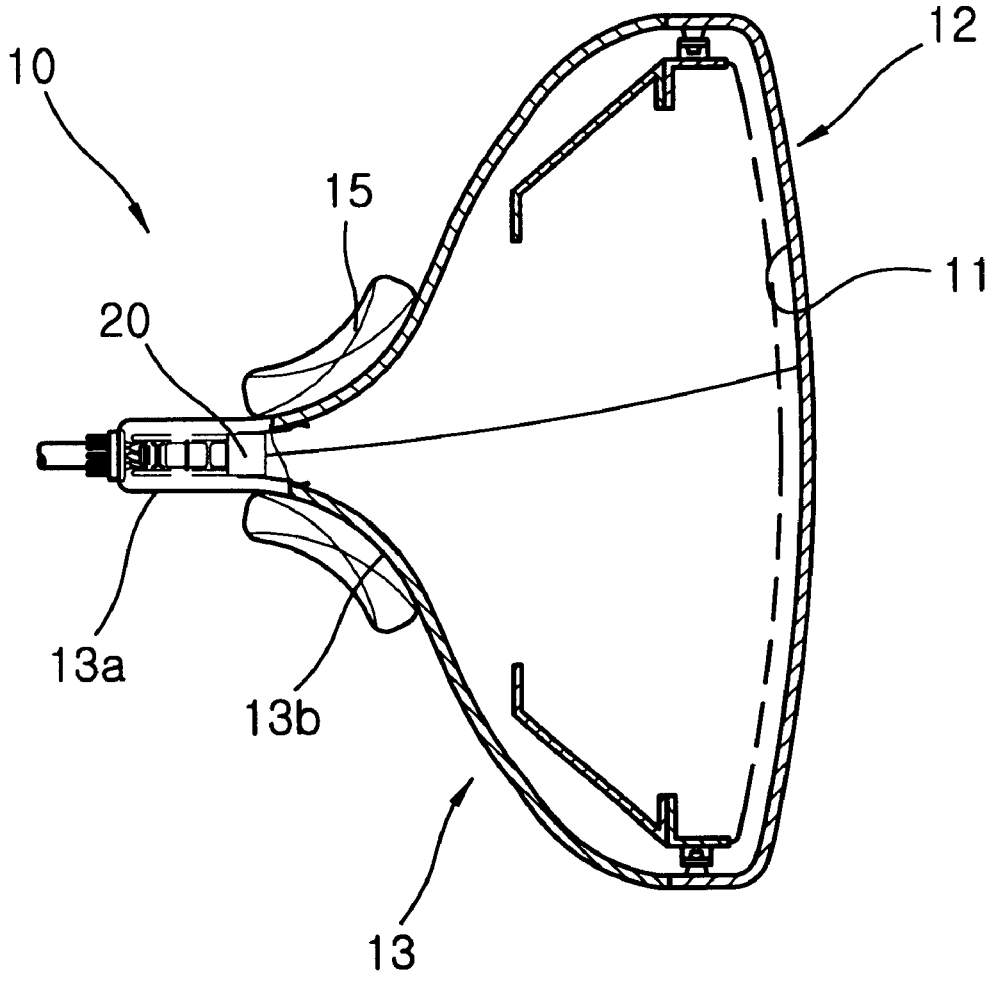
FIG. 1 (PRIOR ART)
FIG. 1 is a sectional view illustrating a typical color cathode-ray tube.
Figure 2:
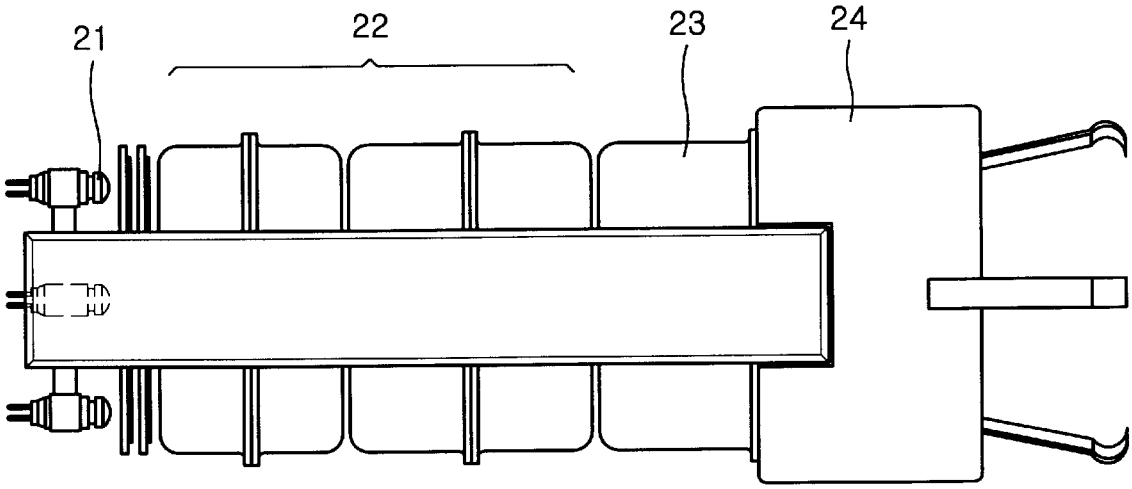
FIG. 2 (PRIOR ART)
FIG. 2 is a plan view illustrating a conventional electron gun.
Figure 3:
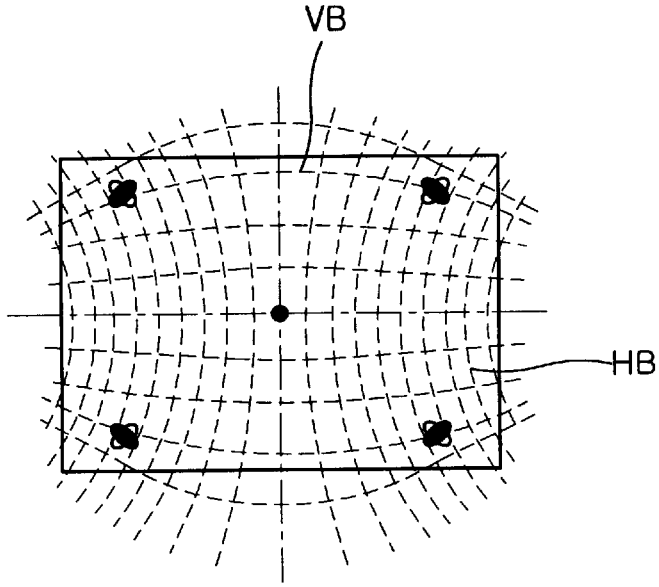
FIG. 3 (PRIOR ART)
FIG. 3 is a diagram in which a deflection magnetic field for deflecting electron beams is visualized.
Figure 4:
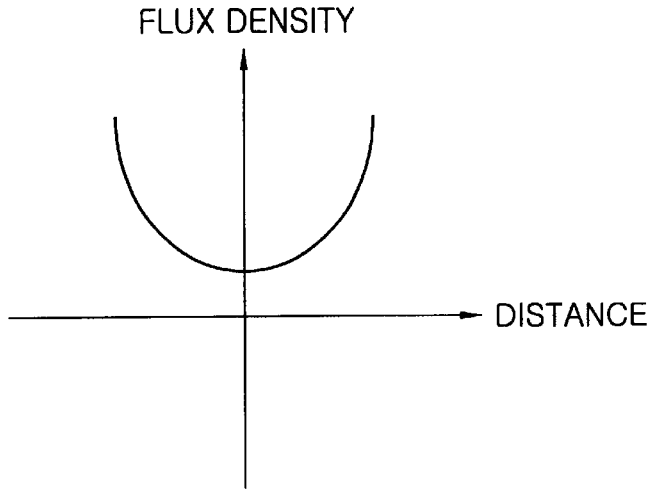
FIG. 4 (PRIOR ART)
FIG. 4 is a diagram illustrating the flux density of a deflection yoke.
Figure 5:
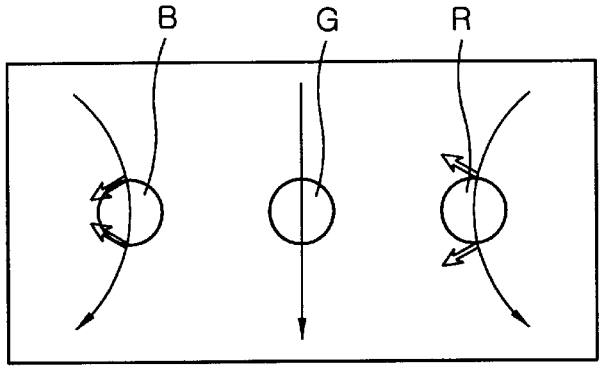
FIG. 5 (PRIOR ART)
FIG. 5 is a diagram illustrating a state in which electron beams are deflected by a pincushion magnetic filed.
Figure 6:
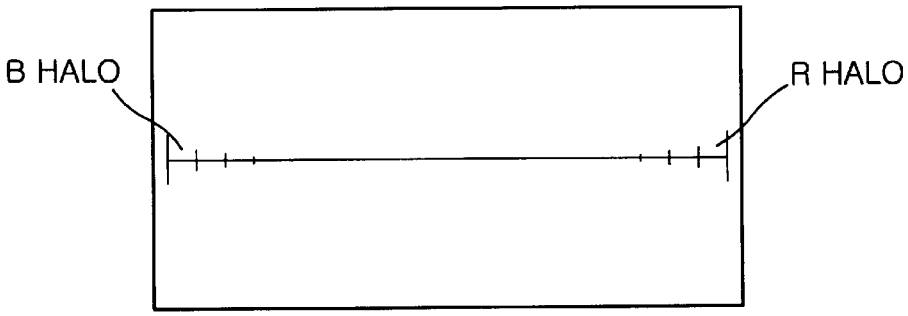
FIG. 6 (PRIOR ART)
FIG. 6 is a diagram illustrating the magnitudes of electron beams when three electron beams are deflected toward the periphery of a phosphor screen.
Figure 21:
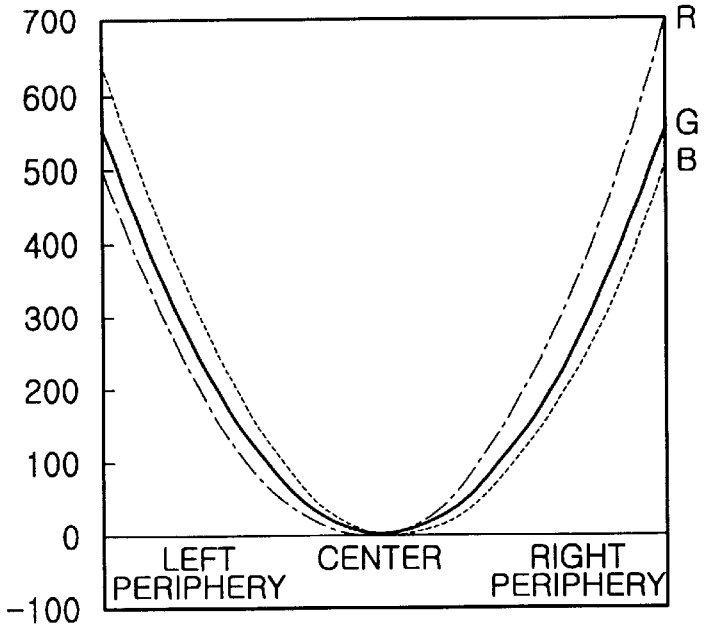
FIGS. 21 and 22 are graphs illustrating dynamic focus voltages of three electron beams before and after application of magnetic pieces, the voltages necessary for deflecting the electron beams to the left and right peripheries of a screen.
Figure 22:
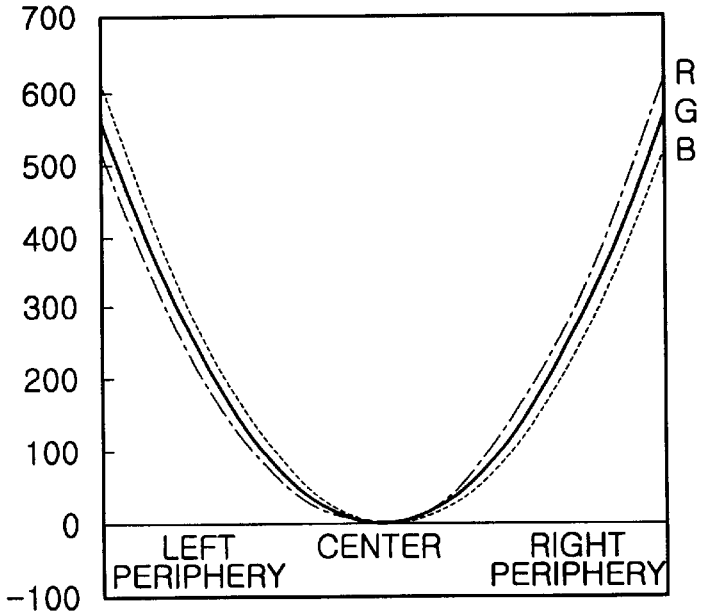

Since electron beams are distorted due to a deflection magnetic field, and thus different focus voltages are necessary for deflecting the electron beams to the left and right peripheries on a screen, different dynamic focus voltages as shown in FIG. 21 should be applied for individual electron beams, respectively, to realize optimal focusing of the three electron beams at the peripheries on a screen. However, in an in-line type electron gun in which three R, G and B electron beam passages are located in a single electrode, the dynamic focus voltage VFD synchronized with a deflection signal is simultaneously applied to the three R, G and B electron beams, so the focusing of the R and B electron beams is degraded, as shown in FIG. 6, under the deflection magnetic field of self-convergence by a deflection yoke, as shown in FIG. 3. A coma correction portion corrects deflection defocusing of the side electron beams so that the difference between dynamic focus voltages necessary for deflecting an electron beam to the left and right peripheries can be reduced, as shown in FIG. 22. Consequently, degradation in focusing side electron beams on the periphery of a screen occurring when a single dynamic focus voltage VFD is applied can be reduced.

Figure 20:
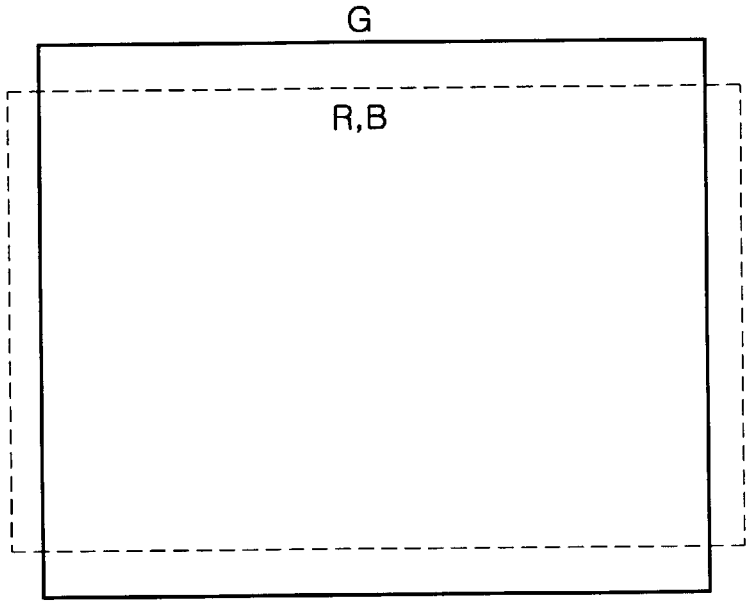
FIG. 20 is a diagram illustrating a change in the deflection shape of three electron beams due to magnetic pieces.
Figure 23:
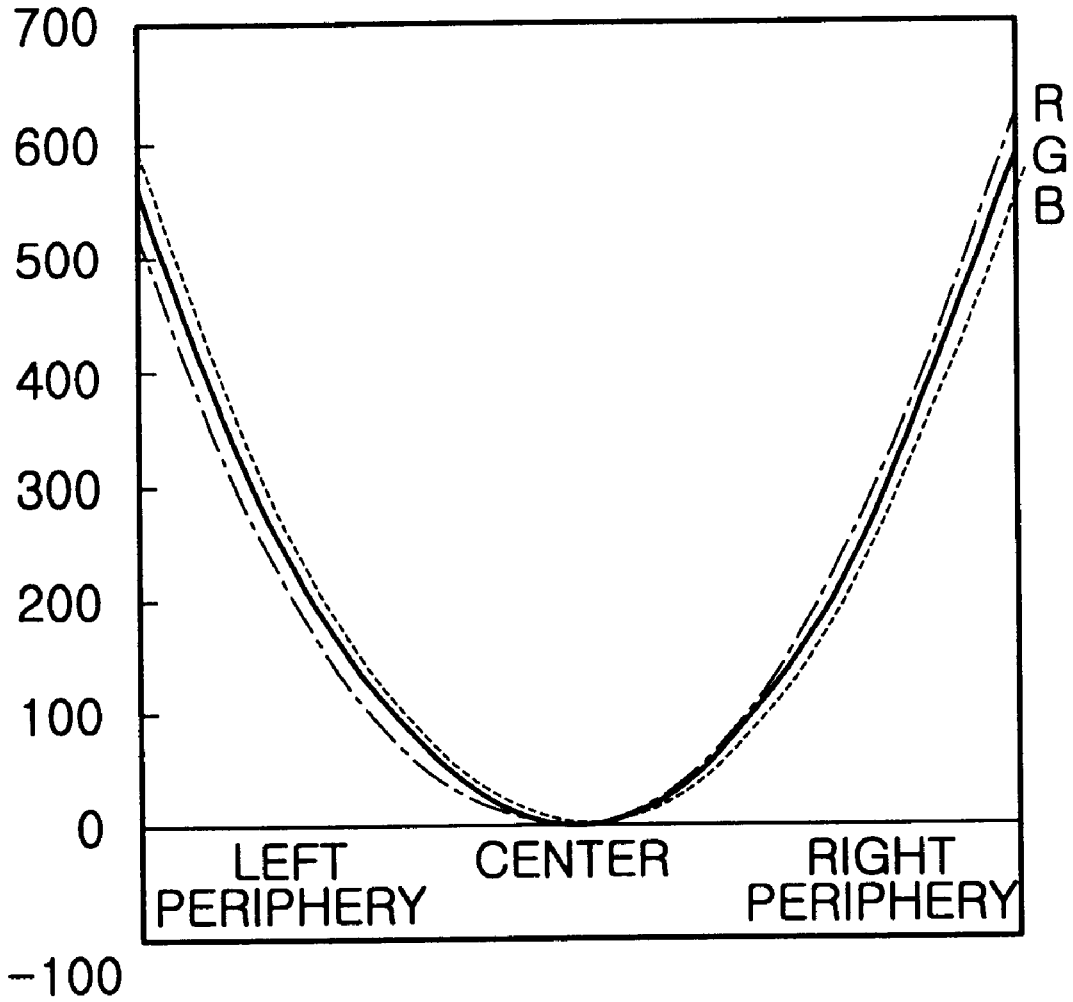
FIG. 23 is a graph illustrating dynamic focus voltages of three electron beams, the voltages necessary for deflecting the electron beams to the left and right peripheries of a screen after a deflection yoke, corrected with respect to which deflection shape, is installed.

Under the non-uniform distribution of a magnetic field formed by a self-convergence deflection yoke, a coma correction portion causes the raster shape between three electron beams on the periphery of a screen to change, as shown in FIG. 20, which results in a change in the magnetic field distribution of the deflection yoke. Consequently, as shown in FIG. 23, left and right dynamic focus voltage difference can be reduced more.

The effects of magnetic pieces in an electron gun described above can be more clearly understood through the following tests.

In the tests, the landing states of electron beams depending on the positions of magnetic pieces, the deflection voltages of side electron beams arranged in line depending on the positions of magnetic pieces, the deflection voltages of side electron beams arranged in line depending on the diameter of magnetic pieces, the landing states of electron beams depending on the thickness of magnetic pieces, and the deflection voltages of side electron beams depending on the thickness of magnetic pieces are observed.

TEST EXAMPLE 1

In this test, it was assumed that the distance from the center of either of the R and B electron beam passages 71 and 73 to the center of each of the magnetic pieces 81–84 of a circular plate toward the G electron beam passage 72 was represented by X, and the distance from the center of either of the R and B electron beam passages 71 and 73 to the center of each of the magnetic pieces 81–84 in a vertical direction, that is, in a direction perpendicular to the in-lin arrangement of the electron beams, was represented by Y. Here, Tables 1 and 2 and FIGS. 13 and 14 are obtained.

TABLE 1

| | X | | |
|---|---|---|---|
| Y | 0.5 | 1.5 | 3.0 |
| 2.5 | −0.410 | −0.365 | −0.205 |
| 3.5 | −0.310 | −0.260 | −0.100 |
| 4.5 | −0.140 | −0.125 | −0.080 |

Figure 13:
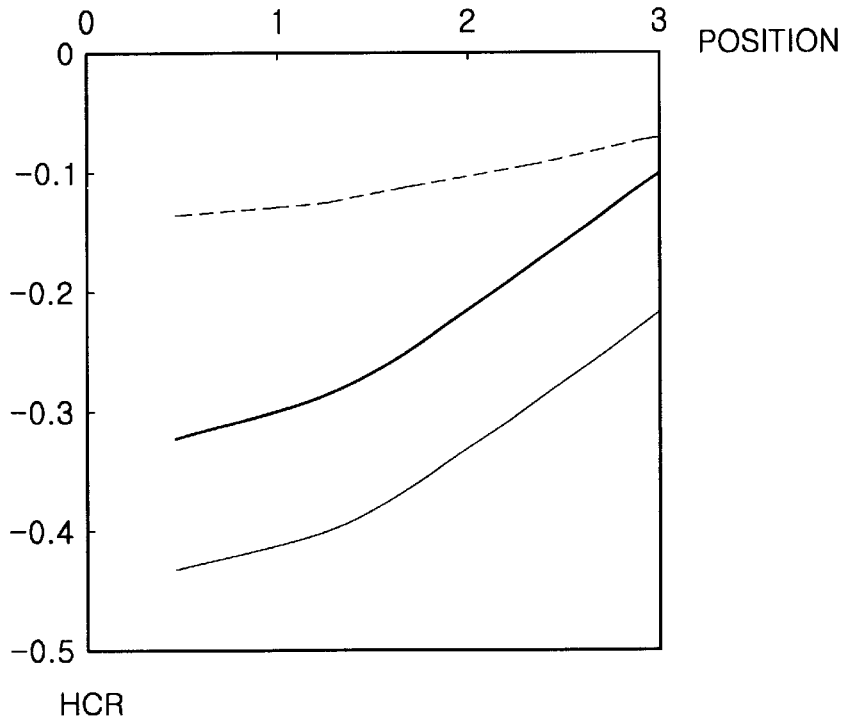
FIGS. 13 and 14 are graphs illustrating the relation between the positions of magnetic pieces and HCR and the relation between the positions of magnetic pieces and VCR.
Figure 14:
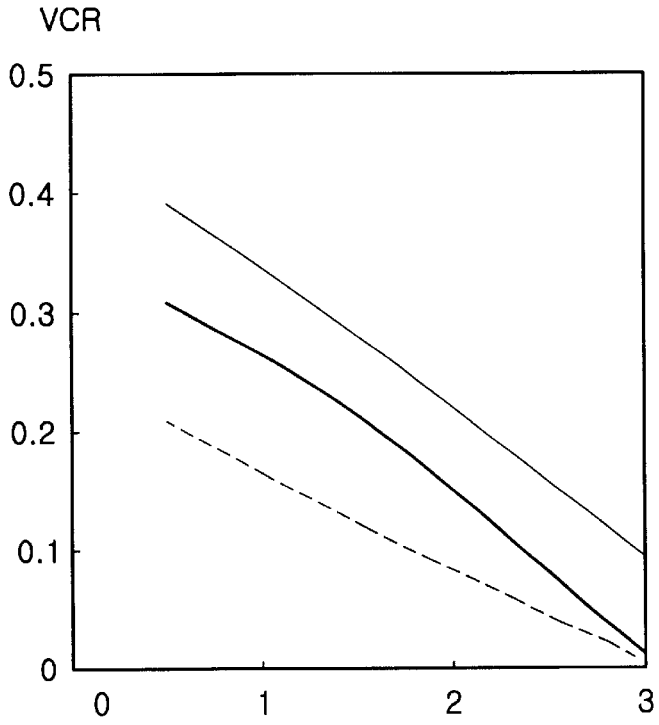

Table 1 and FIG. 13 show the distances HCR between the centers of the R and B electron beams and the center of the G electron beam at the sides (in 3 o'clock direction and 9 o'clock direction) of a phosphor screen in the horizontal direction.

TABLE 2

| | X | | |
|---|---|---|---|
| Y | 0.5 | 1.5 | 3.0 |
| 2.5 | 0.410 | 0.297 | 0.095 |
| 3.5 | 0.323 | 0.223 | 0.010 |
| 4.5 | 0.221 | 0.130 | 0.005 |

Table 2 and FIG. 14 show the distances VCR between the centers of the R and B electron beams and the center of the G electron beam at the sides (in 12 o'clock direction and 6 o'clock direction) of a phosphor screen in the vertical direction.

As seen from Tables 1 and 2 and FIGS. 13 and 14, the HCR values had inflection points when Y is 3.5 and X is 1.5. At the inflection points, a raster pattern formed by the electron beams could be easily corrected.

TEST EXAMPLE 2

In this test, it was assumed that the distance from the center of either of the R and B electron beam passages 71 and 73 to the center of each of the magnetic pieces 81–84 of a circular plate toward the G electron beam passage 72 was represented by X, and the distance from the center of either of the R and B electron beam passages 71 and 73 to the center of each of the magnetic pieces 81–84 in a vertical direction, that is, in a direction perpendicular to the in-lin arrangement of the electron beams, was represented by Y.

Here, Table 3 showing left and right voltage differences of a dynamic focus voltage VFD for achieving optimal focusing when the electron beams were deflected to the left and right peripheries was obtained.

TABLE 3

| | X | | |
|---|---|---|---|
| Y | 0.5 | 1.5 | 3.0 |
| 2.5 | −115 | −80 | −100 |
| 3.5 | −135 | −100 | −125 |
| 4.5 | −185 | −135 | −150 |

Figure 15:
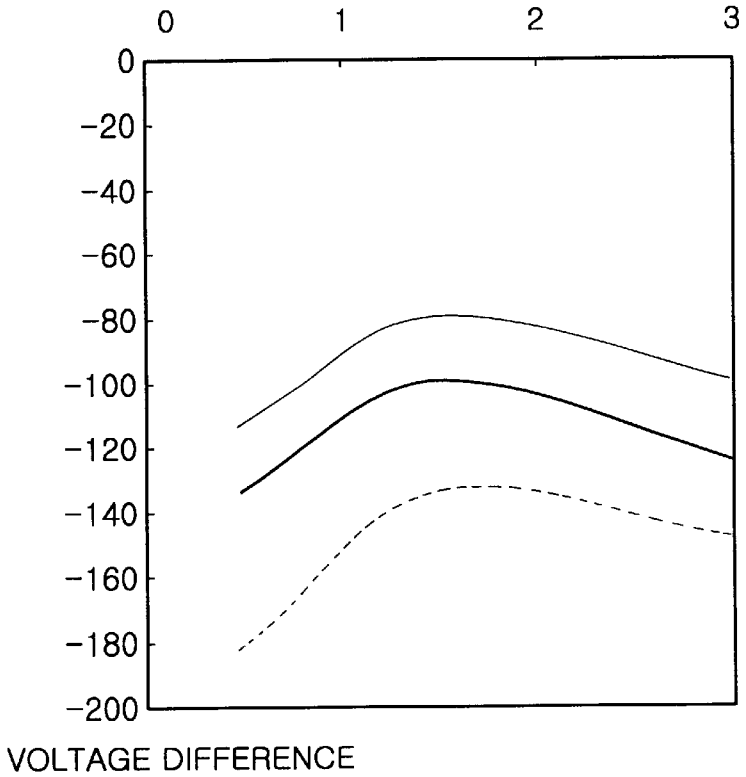
FIG. 15 is a graph illustrating the positions of magnetic pieces and the difference between left and right deflection voltages.

As seen from Table 3 and FIG. 15, when Y was 3.5 and X was 1.5, the left and right voltage difference of the dynamic focus voltage VFD for achieving optimal focusing when the electron beams were deflected to the left and the right was minimized.

TEST EXAMPLE 3

Figure 16:
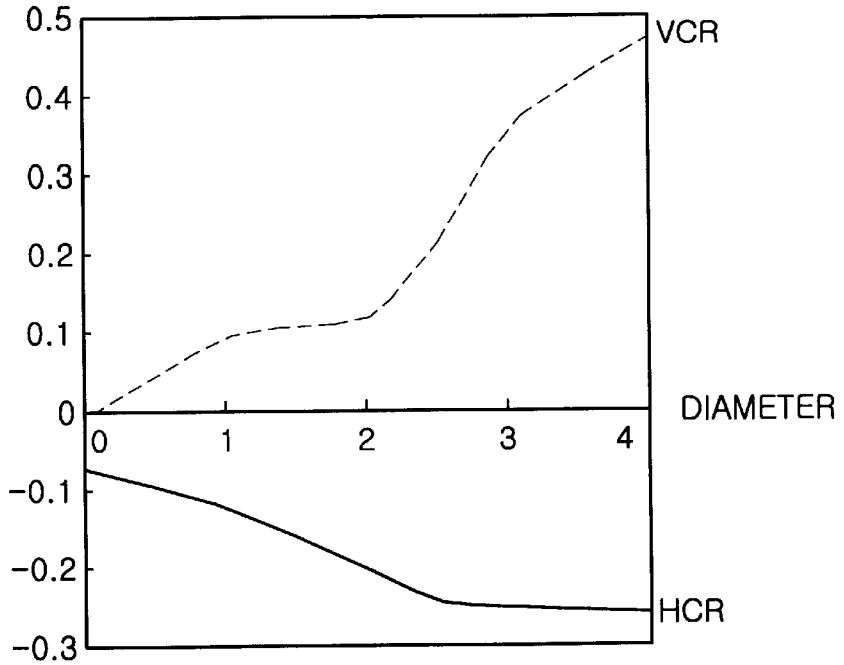
FIGS. 16 and 17 are graphs illustrating the relation between the diameter of a magnetic piece and HCR and VCR and the relation between the diameter of a magnetic piece and a deflection voltage difference.
Figure 17:
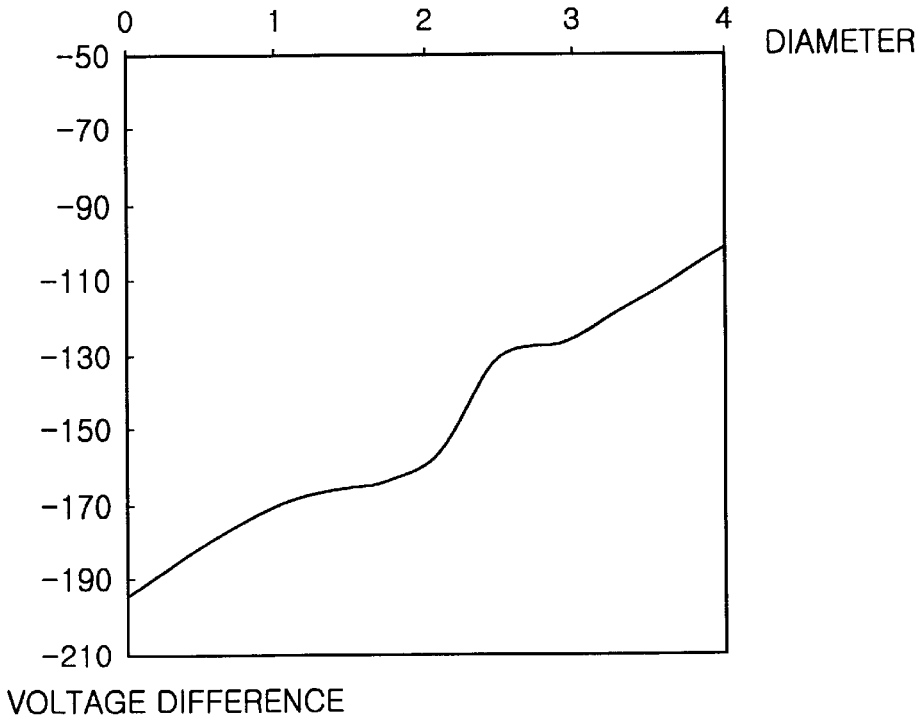

In this test, the relation between the diameter of a magnetic piece of a circular plate and HCR and VCR and the relation between the diameter of a magnetic piece and the difference between left and right dynamic focus voltages VFD for achieving the optimal focusing were observed, and Tables 4 and 5 and FIGS. 16 and 17 were obtained.

TABLE 4

| Diameter of a magnetic piece | 0 mm | 1 mm | 2 mm | 2.5 mm | 3 mm | 4 mm |
|---|---|---|---|---|---|---|
| HCR | −0.07 | −0.122 | −0.198 | −0.24 | −0.248 | −0.252 |
| VCR | −0.01 | 0.087 | 0.118 | 0.223 | 0.355 | 0.475 |

Table 4 and FIG. 16 show changes in HCR and VCR at the same position depending on a change in the diameter of the magnetic piece.

TABLE 5

| Diameter of a magnetic piece | 0 mm | 1 mm | 2 mm | 2.5 mm | 3 mm | 4 mm |
|---|---|---|---|---|---|---|
| Left and right voltage difference | −195 | −170 | −160 | −130 | −125 | −100 |

It was seen from Table 5 and FIG. 17 that the voltage difference was rapidly reduced when the diameter of a magnetic piece was 2.5 mm or larger.

TEST EXAMPLE 4

Figure 18:
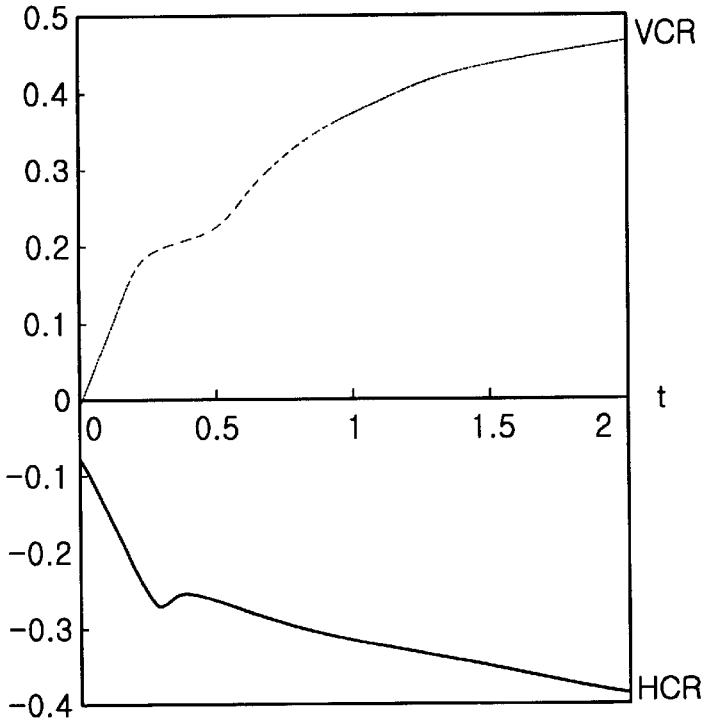
FIGS. 18 and 19 are graphs illustrating the relation between the thickness of a magnetic piece and HCR and VCR and the relation between the thickness of a magnetic piece and a left and right deflection voltage difference.

In this test, the relation between the thickness of a magnetic piece of a circular plate and HCR and VCR and the relation between the diameter of a magnetic piece and the difference between left and right dynamic focus voltages VFD were observed, and Table 6 and FIG. 18 were obtained.

TABLE 6

| Thickness of a magnetic piece | 0.0 mm | 0.25 mm | 0.4 mm | 0.8 mm | 2.0 mm |
|---|---|---|---|---|---|
| HCR | −0.07 | −0.248 | −0.24 | −0.293 | −0.385 |
| VCR | −0.01 | 0.178 | 0.223 | 0.328 | 0.450 |
| Left and right voltage difference | −195 | −150 | −130 | −80 | 50 |

Figure 19:
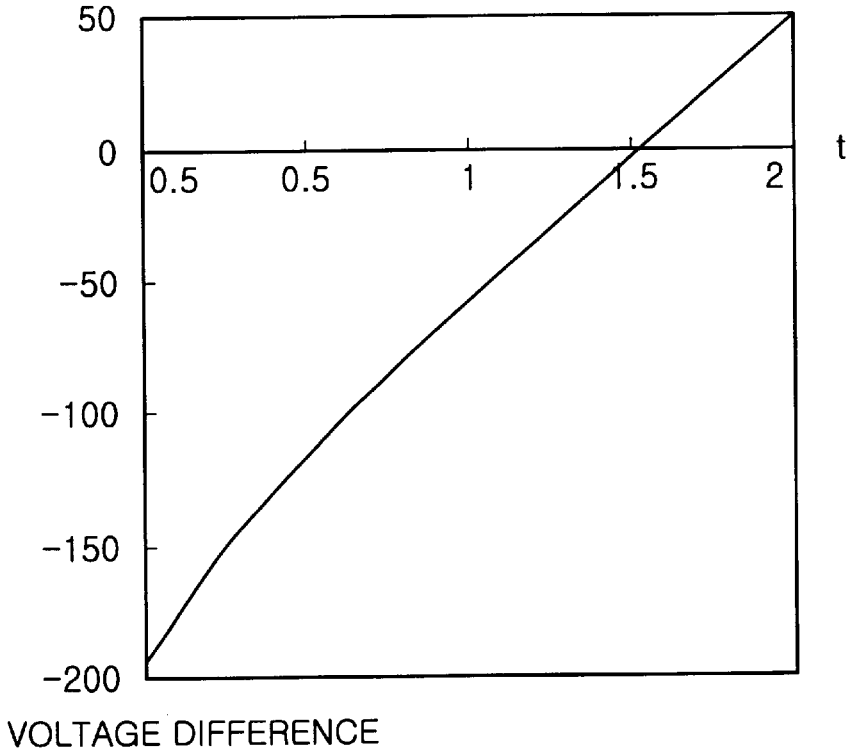

As shown in Table 6 and FIGS. 18 and 19, as the thickness of a magnetic piece increased, the variations of HCR and VCR increased and the left and right dynamic focus voltage VFD difference decreased.

TEST EXAMPLE 5

For the conventional characteristics, effects due to a coma correction portion and effects obtained when convergence is corrected by changing the magnetic field distribution of a deflection yoke when the raster of three electron beams is changed due to the coma correction portion, left and right dynamic focus voltage VFD differences were compared, so that Tables 7, 8 and 9 and FIGS. 21, 22 and 23 were obtained.

TABLE 7

| | Left periphery | Center | Right periphery | Left and right voltage difference |
|---|---|---|---|---|
| R | 500 | 0 | 695 | −195 |
| G | 550 | 0 | 570 | −20 |
| B | 630 | 0 | 510 | −130 |

TABLE 8

| | Left periphery | Center | Right periphery | Left and right voltage difference |
|---|---|---|---|---|
| R | 530 | 0 | 630 | −100 |
| G | 560 | 0 | 580 | −20 |
| B | 610 | 0 | 530 | −80 |

TABLE 9

| | Left periphery | Center | Right periphery | Left and right voltage difference |
|---|---|---|---|---|
| R | 540 | 0 | 620 | −80 |
| G | 560 | 0 | 580 | −20 |
| B | 590 | 0 | 540 | −50 |

Tables 7 and 8 and FIGS. 21 and 22 show changes in a difference between dynamic focus voltages VFD necessary for the deflection to the left and right peripheries on a screen before and after the application of a coma correction portion. It could be seen from Tables 7 and 8 and FIGS. 21 and 22 that the difference between dynamic focus voltages VFD, which should be applied to electron beams when the electron beams are deflected to the left and the right peripheries, was reduced, so that defocusing of side electron beams at the peripheries on the screen could be reduced with a single dynamic focus voltage. In addition, it could be seen from Table 9 and FIG. 23 that the difference between dynamic focus voltages VFD necessary for the deflection to the left and right peripheries of the screen was more reduced due to a change in a magnetic field formed by a deflection yoke when the electron beams were deflected.

TEST EXAMPLE 6

In this test, HCR, VCR and the difference between dynamic focus voltages VFD necessary for the deflection to the left and right peripheries on a screen, which change depending on the material of a coma correction portion, were observed, and Table 10 was obtained.

TABLE 10

| | 42 Ni | 72 Ni |
|---|---|---|
| HCR | −0.260 | −0.335 |
| VCR | 0.223 | 0.293 |
| Voltage difference | −130 | −110 |

It could be seen from Table 10 that as the magnetism of the coma correction portion was stronger, the variations of HCR and VCR increased and the difference between dynamic focus voltages VFD necessary for the deflection to the left and right peripheries on a screen decreased.

As seen from the tests described above, in an electron gun according to the present invention and a color cathode-ray tube using the electron gun, a deflection coma due to the deflection of electron beams to the left and right peripheries of a screen can be reduced by attaching magnetic pieces to the bottom face of a shield cup. Therefore, the diameter of an electron beam in a vertical direction can be reduced by 23% or more, and a voltage difference due to the deflection of electron beams to the left and right peripheries of a screen can be reduced by 60% or more, as compared to conventional technology.

Although the invention has been described with reference to particular embodiments, they should be considered to be descriptive, and it will be apparent to one of ordinary skill in the art that modifications to the described embodiments may be made. Therefore, the scope of the invention will be defined by the technical ideas of the attached claims.

What is claimed is:

1. An electron gun for a color cathode-ray tube, the electron gun comprising cathodes arranged in a line lying in a plane, a plurality of electrodes sequentially disposed relative to the cathodes, each electrode having a central electron beam passage and two side electron beam passages on opposite sides of the central electron beam passage, the central and side electron passages having respective centers aligned along the line, for passing respective electron beams, a shield cup coupled to a last electrode, farthest from the cathodes, among the plurality of electrodes, and provided with three electron beam passages arranged along the line, and a coma correction portion disposed on one of the shield cup and at least one of the electrodes, among the plurality of electrodes, so that the coma correction portion is located above and below the line and in spaces between the center of the central electron beam passage and the centers of the side electron beam passages.

2. The electron gun of claim 1, wherein the coma correction portion comprises a plurality of magnetic pieces attached to a bottom face of the shield cup.

3. The electron gun of claim 2, wherein the magnetic pieces have one of a circular shape and a polygonal shape, a diameter of 1 mm to 4 mm, and a thickness of 0.1 mm to 2.0mm.

4. The electron gun of claim 2, wherein each of the magnetic piece has a center spaced from the center a corresponding side electron beam by 0.5 mm to 3.0 mm toward the central electron beam passage, and the center of each of the magnetic pieces is spaced from the center of the corresponding side electron beam passage by 2.5 mm to 4.5 mm in a direction perpendicular to the line.

5. The electron gun of claim 2, wherein the magnetic pieces constructing the coma correction portion have 30–75% nickel content.

6. The electron gun of claim 2, wherein the magnetic pieces have 42 or 72% nickel content.

7. The electron gun of claim 1, wherein a magnetic field produced by the coma correction portion has a symmetrical distribution with respect to the line along which the electron beam passages are arranged on the shield cup.

8. An electron gun for a color cathode-ray tube, the electron gun comprising three cathodes arranged in a line lying in a plane, a control electrode, a screen electrode, a plurality of electrodes sequentially relative to the screen electrode and forming an auxiliary lens, a main lens, a final accelerating electrode, a shield cup coupled to the final accelerating electrode, the control and screen electrodes including a central electron beam passage and two side electron beam passages on opposite sides of the central electron beam passage, the central and side electron beam passages having respective centers arranged along the line, and a coma correction portion comprising at least a pair of magnetic pieces which are disposed on one of the shield cup and one of the plurality of focus electrodes so that centers of magnetic pieces are positioned above and below the line and in spaces the center of the central electron beam passage and the centers of the side electron beam passages in the control electrode and the screen electrode.

9. The electron gun of claim 8, wherein the coma correction portion comprises a plurality of magnetic pieces attached to a bottom face of the shield cup.

10. The electron gun of claim 9, wherein the magnetic pieces have one of a circular shape and a polygonal shape, a diameter of 1 mm to 4 mm, and a thickness of 0.1 mm to 2.0 mm.

11. The electron gun of claim 9, wherein each of the magnetic piece has a center spaced from the center a corresponding side electron beam by 0.5 mm to 3.0 mm toward the central electron beam passage, and the center of each of the magnetic pieces is spaced from the center of the corresponding side electron beam passage by 2.5 mm to 4.5 mm in a direction perpendicular to the line.

12. The electron gun of claim 8, wherein the magnetic pieces constructing the coma correction portion have 30–75% nickel content.

13. The electron gun of claim 8, wherein a magnetic field produced by the pair of magnetic pieces has a symmetrical distribution with respect to the line along which the electron beam passages are arranged on the shield cup.

14. An electron gun for a color cathode-ray tube, the electron gun comprising three cathodes arranged in a line lying in a plane;

a control electrode and a screen electrode sequentially disposed relative to the cathodes;

a plurality of focus electrodes sequentially disposed from the screen electrode and to which a dynamic focus voltage synchronized with a deflection signal is applied, thus forming a quadrupole lens;

a final accelerating electrode adjacent to the focus electrodes and forming a main lens;

a shield cup coupled to the final accelerating electrode farthest from the cathodes, the shield cup and the control and screen electrodes including a central electron beam passage and two side electron beam passages on opposite sides of the central beam passage, the central and side electron passages having respective centers aligned along the line; and at least a pair of magnetic pieces disposed on one of the shield cup and one of the plurality of focus electrodes located above and below the line and in spaces between the center of a central electron beam passage and the centers of the side electron beam passages in the control electrode, the screen electrode, and the shield cup.

15. The electron gun of claim 14, wherein the coma correction portion comprises a plurality of magnetic pieces attached to a bottom face of the shield cup.

16. The electron gun of claim 15, wherein the magnetic pieces have one of a circular plate shape or and a polygonal shape, a diameter of 1 mm to 4 mm, and a thickness of 0.1 mm to 2.0 mm.

17. The electron gun of claim 14, wherein each of the magnetic piece has a center spaced from the center a corresponding side electron beam by 0.5 mm to 3.0 mm toward the central electron beam passage, and the center of each of the magnetic pieces is spaced from the center of the corresponding side electron beam passage by 2.5 mm to 4.5 mm in a direction perpendicular to the line.

18. The electron gun of claim 14, wherein a magnetic field produced by the pair of magnetic pieces has a symmetrical distribution with respect to the line along which the electron beam passages are arranged on the shield cup.

19. A color cathode-ray tube comprising:

a housing comprising a panel having an internal phosphor screen and a funnel fastened to the panel, the funnel including a neck;

an electron gun housed in the neck and emitting electron beams for exciting the phosphor screen and forming an image, cathodes arranged in a line lying in a plane, a plurality of electrodes sequentially disposed relative to the cathodes and having a central electron beam passage and two side electron beam passages on opposite sides of the central electron beam passage, the central and side electron passages having respective centers aligned along the line, for passing three electron beams, a shield cup coupled to a last electrode, farthest from the cathodes, among the plurality of electrodes, and provided with three electron beam passages arranged along the line, and magnetic pieces disposed on one of the shield cup and at least one of the electrodes among the plurality of electrodes so that the magnet pieces are located above and below the line and in spaces between the center of the central electron beam passage and the centers of the side electron beam passages; and a deflection yoke disposed on the neck of the funnel, the deflection yoke deflecting electron beams emitted from the electron gun to positions on the phosphor screen.

20. A color cathode-ray tube comprising:

a housing comprising a panel having an internal phosphor screen and a funnel fastened to the panel, the funnel including a neck;

an electron gun housed in the neck and emitting electron beams for exciting the phosphor screen and forming an image, cathodes arranged in a line lying in a plane, a plurality of electrodes sequentially disposed relative to the cathodes and having a central electron beam passage and two side electron beam passages on opposite sides of the central electron beam passage, the central and side electron passages having respective centers aligned along the line, for passing three electron beams, a shield cup coupled to a last electrode, farthest from the cathodes, among the plurality of electrodes, and provided with three electron beam passages arranged along the line, and magnetic pieces disposed on one of the shield cup and at least one of the electrodes among the plurality of electrodes so that the magnet pieces are located above and below the line and in spaces between the center of the central electron beam passage and the centers of the side electron beam passages;

a deflection yoke disposed on the neck of the funnel, the deflection yoke deflecting electron beams emitted from the electron gun to positions on the phosphor screen and barreling a pincushion magnetic field for adjustment of coma by the magnetic pieces; and a coma-free magnet producing a magnetic field weakened in synchronization a magnetic field produced by the deflection yoke.

* * * * *